United States Patent [19]

Chamberlain

[11] 4,269,901

[45] May 26, 1981

[54] DEVICE FOR PROTECTION AGAINST FIRE

[76] Inventor: Francis N. Chamberlain, 69 Wood St., Dalby, Queensland, Australia, 4405

[21] Appl. No.: 64,505

[22] Filed: Aug. 7, 1979

[51] Int. Cl.[3] ..... A47G 5/04

[52] U.S. Cl. ..... 428/542; 428/432; 428/920; 428/906

[58] Field of Search ..... 160/24–135, 160/351–352; 428/542, 432, 920, 906

[56] References Cited

U.S. PATENT DOCUMENTS

| | | | |
|---|---|---|---|
| 158,217 | 12/1874 | Low | 160/352 X |
| 935,248 | 12/1909 | Dennis | 160/352 X |
| 973,936 | 10/1910 | Graves | 160/352 X |
| 1,009,620 | 11/1911 | Adams | 160/135 |
| 1,194,913 | 8/1916 | Wolfe | 160/352 |
| 2,350,207 | 5/1944 | Wyscaver | 160/351 X |
| 2,823,744 | 2/1958 | Garris | 160/351 X |
| 3,251,264 | 5/1966 | Jacobson | 160/24 X |

*Primary Examiner*—Henry F. Epstein

*Attorney, Agent, or Firm*—Schwartz, Jeffery, Schwaab, Mack, Blumenthal & Koch

[57] ABSTRACT

A shield for protection against fire consists of a flexible sheet of heat-insulating material having a resiliently flexible top stiffener secured across its top. Behind the sheet and secured to the top stiffener are two laterally spaced top handles arranged so one can be grasped by a hand, the other engaged and supported by the raised and more or less horizontal forearm, to hold the sheet, which has a window of transparent heat-resistant material, fully extended in front of the user. The sheet has a further transverse resiliently flexible stiffener across its middle part, and also a single central lower handle, and it may be weighted at its bottom.

10 Claims, 2 Drawing Figures

DEVICE FOR PROTECTION AGAINST FIRE

BACKGROUND OF THE INVENTION

This invention relates to a device for protection against fire.

It is not uncommon for people to lose their lives in a burning house or other building because the heat of the fire has prevented them from making their way to an exit. For example, the way to a safe exit may be along a passage, but past a doorway of a blazing room, from which the flames extend across the passage. Rescue attempts may also be prevented by flame and heat which may be fairly localized, and although fire brigades are normally equipped with heat-insulated clothing, they may not be called early enough to prevent fatalities.

The general object of the present invention is to provide a heat-insulating shield device which is easy to use, to shield a person from heat, and also usable for preventing undue passage of heat from a doorway, for example, and which is capable of being folded into a compact space for storage or transport.

BRIEF SUMMARY OF THE INVENTION

With the foregoing and other objects in view, the invention resides broadly in a heat shielding device including a flexible sheet of heat-insulating material, a resiliently flexible top stiffener member secured to the top of the sheet for holding it transversely extended, a top handle behind the sheet and connected to the top stiffener member, whereby a user may hold the sheet upright, and a window of transparent heat-resistant material in the sheet. Preferably a second top handle is provided behind the sheet and secured to the top stiffener member, the two top handles being spaced laterally and of such nature that a user's hand may grasp one, the other engaging the user's raised and more or less horizontally held forearm, leaving free his other hand, which may be used to hold a bottom handle, behind the middle part of the sheet. Preferably means are provided for weighting the bottom of the sheet, and preferably a second transverse resiliently flexible member is fixed across an intermediate part of the sheet. Other features of the invention will become apparent from the following description.

BRIEF DESCRIPTION OF THE DRAWINGS

A preferred embodiment of the invention is shown in the accompanying drawings, wherein.

DETAILED DESCRIPTION OF THE PREFERRED EMBODIMENT

Figure 1:
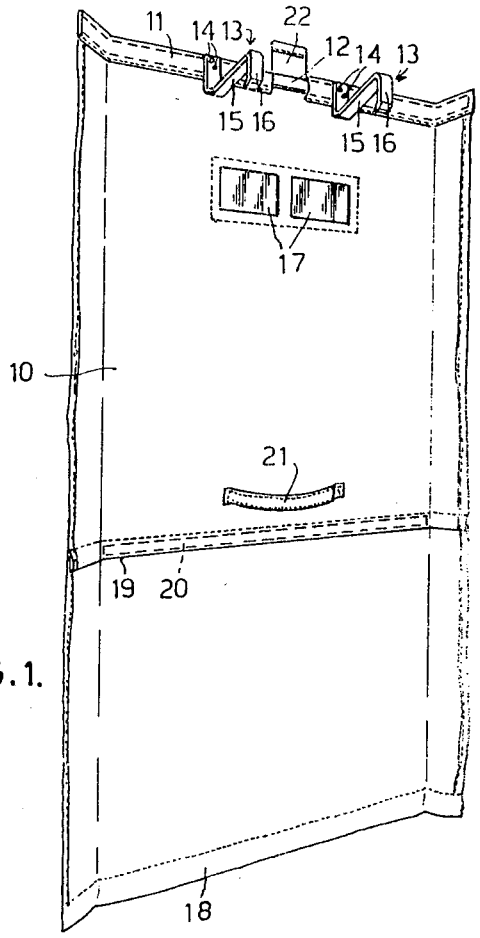
FIG. 1 is a perspective view from the rear of a heat shielding device according to the invention.
Figure 2:
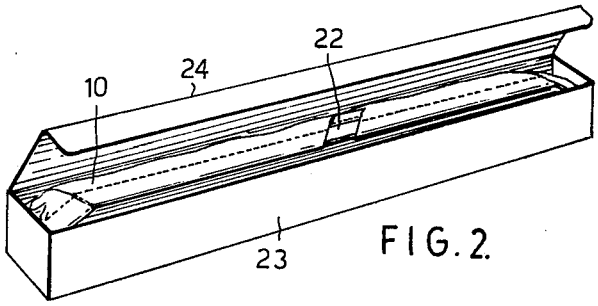
FIG. 2 is a perspective view of the device folded in a case.

The heat-insulating shield device illustrated includes a substantially rectangular pliable sheet 10 of heat insulating flexible material forming a curtain, which may suitably be aluminized fibre-glass material, that is to say a fabric woven of fibre-glass and with at least one surface, which is the front or face of the sheet, aluminized for high reflection of heat. The height of the sheet is preferably about six feet, and its width is preferably about three feet.

A seam 11 is formed across the top of the sheet, and housed in this is a top stiffener member 12, which is a resiliently flexible bar of spring steel, with its two end portions inclined rearwardly.

A pair of handles 13 are secured to the middle part of the rear of the top stiffener member 12, each of these handles being a metal bar which at one end is riveted at 14 to the top stiffener member 12 and extends downwardly therefrom for some distance, then being bent to incline upwardly and rearwardly to form a hand grip 15, of which the end portion is bent fairly sharply down to form a retaining piece 16. The two handles 13 are spaced apart in parallel relationship and are such that a user of the heat shielding device may conveniently grasp one of the hand grips 15, say the left-hand one, with his right hand, his raised and more or less horizontal right forearm passing under the other hand grip, which is prevented from accidental disengagement by the associated retaining piece 16. The user of the device, then, can conveniently hold the sheet 10 upright, its bottom on or near to the floor, and with all of his body, including his hands, behind the protective sheet 10.

When the shield is so held, a user can see through it to the front, as a pair of adjacent windows 17 of any suitable heat-resistant transparent material are fitted and secured in appropriate openings in the sheet.

The bottom of the sheet 10 may be weighted, a seam or transverse pouch 18 across the bottom of the sheet being filled with sand or other suitable material.

At a position about midway between the top and the bottom of the sheet 10, there is formed a further transverse seam 19 in which there is housed a second or intermediate stiffening member 20 which, like the top member 12, may be a bar of spring steel. However, the intermediate stiffening member 20 does not extend fully to the sides of the sheet 10, but is about the same length as the main middle straight part of the top stiffener member 12.

Close above the level of the intermediate stiffener member 12, a bottom handle 21 is provided at the rear of the sheet, and this consists of a strip of flexible material with its ends stitched or otherwise secured to the sheet.

A pull tag 22, the purpose of which will hereinafter be explained, extends upwardly from the middle of the top of the sheet 10 and may be a separated back piece of the seam 11 at the top of the sheet.

The flexible shield may be quickly and easily folded into a compact roll which can be easily accommodated in a case 23 of laterally elongated form and square cross-section, which may be mounted on any suitable supports on a wall, the box having a top lid 24 which can be raised to give access to the shield, which is folded in such a way that the pull tag 22 is exposed. By opening the lid and lifting up the pull tag, the whole shield is quickly extracted from its case, and a person holding the top handles 13 of the shield as before described, with one hand and arm, and possibly holding the lower handle 21 with the other hand, will immediately be protected from heat to his front. A person so shielded will be able to approach close to a fire, and, in some cases, pass through it without risk, and moreover will be able by lifting the shield to cover an open doorway to prevent flame from passing through the doorway. One person equipped with the shield, then, may be able to make safe a passage leading to the exit from a building. Owing to the resiliently flexible nature of the top and intermediate stiffening members, a person using the shield may pass through restricted openings, the stiffeners bending back at the sides, and returning to extended positions when the opening has been passed.

I claim:

1. A shield for protection against fire, comprising:

a pliable curtain of heat-insulating material having front and rear faces;

a resilently flexible top stiffener member secured to and extending along an upper edge of said curtain for holding said curtain transversely extended;

a window of transparent, heat-resistant material in an upper part of the sheet; and an upper handle secured at the rear face of said curtain to said top stiffener member;

said shield being rollable into a compact roll for storage, and being vertically extendible for protection against fire by lifting said handle such that said curtain is suspended from and transversely extended by said top stiffener member.

2. A shield for protection against fire according to claim 1, further comprising a second upper handle secured at the rear face of said curtain to said top stiffener member, said upper handles spaced from one another along said top stiffener member, each said upper handle adapted to be grasped by a hand and at least one said upper handle adapted to engage a raised, substantially horizontal forearm of a user of the shield, whereby said upper handles may be lifted and held by one arm of the user such that said curtain is suspended from said top stiffener member in front of the user.

3. A shield for protection against fire according to claim 2, further comprising a resiliently flexible intermediate stiffener member secured to and extending transversely across a center portion of said curtain, and a lower handle secured at the rear face of said center portion of said curtain.

4. A shield for protection against fire according to claim 3, further comprising weighting means provided at a lower portion of said curtain.

5. A shield for protection against fire according to claim 4, wherein said weighting means is sewn into a seam at a lower edge of said curtain.

6. A shield for protection against fire according to claim 3, wherein said intermediate stiffener member is sewn into a seam at said center portion of said curtain.

7. A shield for protection against fire according to claim 1, wherein said top stiffener member is sewn into a seam at said upper edge of said curtain.

8. A shield for protection against fire according to claim 1, wherein said curtain comprises a fabric woven of fiberglass.

9. A shield for protection against fire according to claim 8, wherein said woven fiberglass fabric curtain is aluminized on said front face for reflection of heat.

10. A shield for protection against fire according to claim 1, further comprising a pull tag attached to and extending upwardly from a center portion of said upper edge of said curtain, whereby lifting of said pull tag extends said shield from a compact storage position to a position of use in which said curtain is suspended from said top stiffener member.

* * * * *